United States Patent [19]

Barber

[11] Patent Number: 4,689,858

[45] Date of Patent: Sep. 1, 1987

[54] ADJUSTABLE RUBBER BAND

[76] Inventor: Michael T. Barber, 6427 Eppard St., Falls Church, Va. 22044

[21] Appl. No.: 873,728

[22] Filed: Jun. 12, 1986

[51] Int. Cl.[4] ..... B65D 63/00

[52] U.S. Cl. ..... 24/17 B; 24/265 BC; 24/570

[58] Field of Search ..... 24/17 B, 17 AP, 3 A, 24/265 BC, 265 AL, 129 A, 570; 248/743

[56] References Cited

U.S. PATENT DOCUMENTS

| | | | |
|---|---|---|---|
| 41,720 | 2/1864 | Richardson | 24/17 B |
| 203,599 | 5/1878 | Cutliff | 24/570 |
| 656,431 | 8/1900 | Stewart | 24/129 A |
| 912,204 | 2/1909 | Tacy | 24/570 |
| 1,394,720 | 10/1921 | Feltman | 24/570 |
| 1,414,476 | 5/1922 | Lakin | 24/3 A |
| 1,960,690 | 5/1934 | Blair | 24/17 B |
| 2,189,574 | 2/1940 | Anderson | 24/265 BC |
| 2,449,882 | 9/1948 | Daniels | 24/3 A |
| 3,969,792 | 7/1976 | Hattori | 24/17 B |
| 4,237,174 | 12/1980 | Lagardere et al. | 24/265 BC |

*Primary Examiner*—Victor N. Sakran

[57] ABSTRACT

A fastening device comprised of an elastic band permanently attached at one end either in a utilitarian sense or in a static sense and temporarily attached at the other end, of which is adjustable by pulling on this unattached end, to a simple clasp with holes of a similar diameter as the elastic band and of which secures the band to a specific total circumference and range of tensile strength by the force of friction generated between the band and clasp.

1 Claim, 5 Drawing Figures

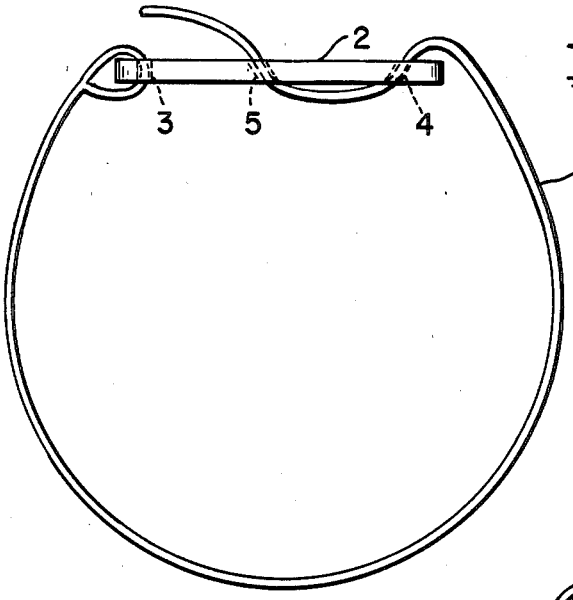
Fig.1
Fig.2
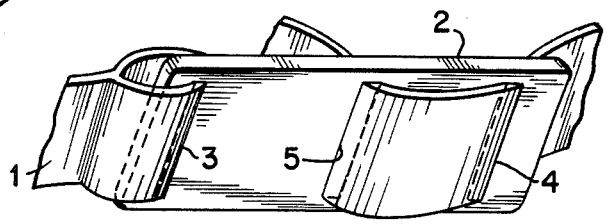
Fig.3
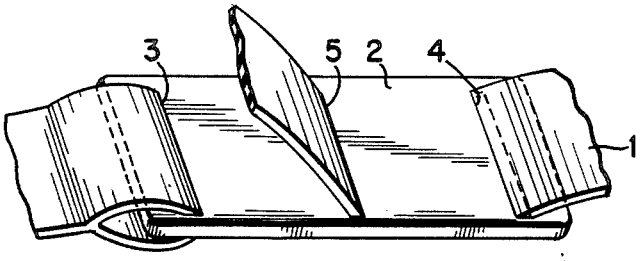
Fig.4
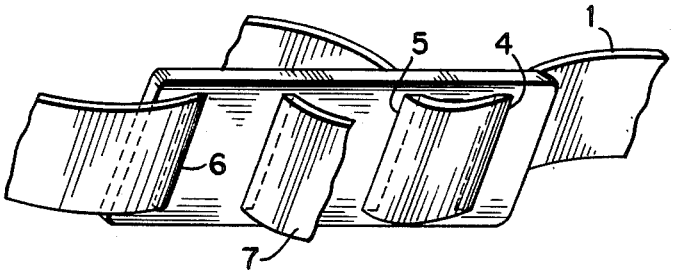
Fig.5
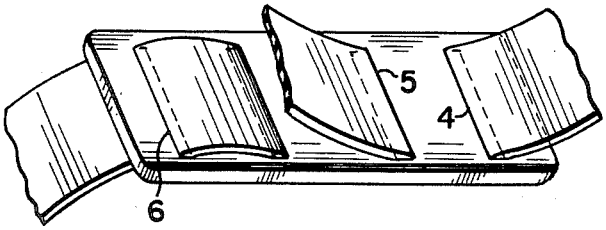

ADJUSTABLE RUBBER BAND

BACKGROUND

The invention herein described relates to a fastening device for the collection of adherence of an article or articles, and an improvement over conventional fastening devices, more specifically, the conventional rubber band.

Hereto before, fastening devices such as the rubber band have been limited by the specific dynamic range of the tensile strength of the rubber used. In some cases, the tensile strength of the rubber is greater than the strength of the articles being held. Such a situation then arises where the articles or article is damaged or crushed. The problem then requires the need for many different sizes of rubber bands, none of which may match a particular use exactly. The advantages of an elastic force are evident in that objects which are to be retained can be retained as closely together as possible and later adjustments which may be necessary because of material shrinking is not needed. The rubber band provides such an elastic force but its force is narrowly confined to a specific tensile tolerance, outside this range, objects are either held too loosely or the rubber band breaks. The range of the Adjustable Rubber Band is extended to all practical applications in a single device.

A further limitation of the conventional rubber band is that the device is completely enclosed, therefore, limited to the fastening of articles with small overall length. Present patents do exist which remedy this difficulty. The conventional cable ties of U.S. Pat. No. 4,532,679 by Scott, U.S. Pat. No. 4,537,432 by Meeks, U.S. Pat. No. 4,573,242 by Lawkton et al., or U.S. Pat. No. 145,073 by R. P. Stoats. These devices, or course, are severely limited because they lack the elastic force generated by the rubber band. As objects become more tightly compact due to retension, these devices fail and must be retightened. Moreover, they incorporate the use of ratchet type devices to hold adjustment which is often not reversible without the destruction of the device. Even when the problem of reversibility is solved, as in U.S. Pat. No. 4,559,676 by Paradis, the advantages of elasticity, which continually applies an inward force of retension, are not incorporated.

The Adjustable Rubber Band provides the advantages of previous related fastening devices without their limitations. It has the ability to retain objects together providing a constant inward elastic force, the ability to be applied at any point along the length of the object or objects, the ability to adjust to virtually any circumference, and the ability for an adjustment to be reversed and therefore reused at practically no additional cost.

SUMMARY

The invention comprises an elastic band whose total length then provides a maximum circumference joined together at a clasp. The clasp may be made of any material, but the preferred embodiment employs die cut polymer.

The elastic band is permanently retained at one end of the clasp. The elastic band, for instance, may be secured by gluing, by melting the polymer and elastic together or by sandwiching the elastic within the polymer. The preferred embodiment is secured by joining a small loop of the elastic band to itself with the clasp attached. An alternative design, which is more economical, is secured by friction using the same principle as the adjustable end, and this end is then considered permanent in a utilitarian sense.

The adjustable end of the band is threaded down and up through two holes in the clasp and is held by friction generated betwen the elastic band and clasp. The elasticity of the band, while in use, provides downward force on the clasp between the openings where the width of the band is not affected during normal stretching and which keeps the adjustment a constant preventing the retaining device from loosening. Adjustment is provided for by simply pulling on the free end which is never permantly retained. Because of the friction between the elastic band and the clasp, the amount of adjustment is directly proportional to the stability of the adjustment. Therefore, the band will slip if the tensile strength of the elastic is reached.

The clasp may be of different colors which can aid in coding the collection of a set of articles. Furthermore, the die cut polymer may be cut with a tag extended for a similar result or stamped with information. The excess elastic may be threaded through belt loop devices but it is not necessary. Whether they be chemical or physical, the only limits to the articles which may be held are those which have properties such as heat that may affect the strength of the band or clasp.

Many alternative designs of the clasp and band are possible which achieve the same effect including extensions in or about the slits or different weaving patterns of the elastic band through the clasp. This specification should not be considered a limitation on those modifications or alternative designs which will infringe on the spirit of this present invention.

DIAGRAMS

The present invention may be further understood with reference to the diagrams in which:

FIG. 1—shows the entire Adjustable Rubber Band in side view.

FIG. 2—shows a bottom-side crossectional view of the clasp.

FIG. 3—shows a top-side crosssectional view of the clasp.

FIG. 4—shows an alternative design of the clasp from a bottom-side cross-sectional view.

FIG. 5—shows an alternative design of the clasp from a top-side cross-sectional view.

DETAILED DESCRIPTION

The invention forthwith described can be seen in FIG. 1 where numeral 1 shows the elastic band and 2 shows the clasp both in side view. For clarity, the bottom will be considered that side which lies closest to the article or articles being held.

FIG. 2 shows the clasp in crosssection from the bottom and side where the elastic band is permanently attached at 3. The other end of the elastic band goes through the top entering the bottom at 4 and through 5 back to the top. As the elastic band is stretched when used, the width of the band between 4 and 5 remains the same; consequently, this area of the rubber band in conjunction with the clasp provides friction sufficient to prevent any adjustment from changing. The friction is sufficient to prevent change of adjustment but is less than the tensile strength of the elastic band. In the event, the elastic band is overstretched, the force of friction will be encountered first; therefore, the band slips rather than breaks. The primary reason the adjustment does not change is that the width of an elastic band decreases only between the two secured points; in this case, those two points are 3 and 4.

FIG. 3 shows a top and side crosssectional view which incorporates a reverse view of FIG. 2. Again the elastic band is permanently attached at 3, with 4 and 5 representing identical attachments as in FIG. 2 but from the top. The free end of the elastic band at 5 is where the user makes adjustments to the appropriate range of tensile strength. Of course, the elastic band may enter from position 5 and go back through position 4 which is not shown and is considered a priori from that which has been described.

FIG. 4 shows an alternative design which is more economical in that the permanent end of the elastic band is still permanently attached but only in a utilitarian sense. The view shown is a bottom and side view of the alternative clasp design. The end of the elastic band considered permanent enters at 6 through the bottom to the top of the clasp and then returns back down at 7. Position 4 and 5 are identical to previous diagrams. The alternative design is considered more economical because the elastic band need not be attached to itself at the permanent end. Additional slots may be provided to increase friction on the permanent end but it is not necessary. Many other methods of attachment may be used at the permanent end including gluing, melting the band to the polymer or sandwiching the band between the polymer.

FIG. 5 is a reverse view of FIG. 4 where the top and side of the clasp are shown. The numerals in FIGS. 4 and 5 are identical in that they correspond to the same locations on alternative sides.

With respect to the attached specification, I claim:

1. A fastening device consisting of a flat rectangular piece of polymer plastic which forms a clasp with two sets of two equally spaced slits at either end of the clasp, where rubber material exhibiting a high coefficient of friction, forms a band which is temporarily adjusted by entering one of the two sets of slits at one end, transversing the distance between this slit and the next closest slit of the set from the opposite side of the clasp to form a temporary adjustment of the length of the band because of material/material friction between the rubber band surface and the polymer/plastic surface, and whose adjustment remains constant because of this material/material friction and the fact that the width of the band between the slits upon stretching remains conserved showing little or no decrease in the total frictional force between the rubber and plastic surface, and where the other end of the band is permanently attached in a utilitarian sense to the clasp by entering the second set of slits at the opposite end of the clasp as was described for the temporarily adjusted end, or by some other permanent means, to form any designated circumference allowed by the total length of the band to retain an object or objects which are classified by using different colored polymer/plastic clasps, by the use of printed tag extensions on the side of the clasp or by employing an ink marker to write on the top of the clasp, wherein the free end of the band is adapted to pass over an end portion of said clasp through the adjacent slit end portion, then passes under the clasp and through the associated slit and above the clasp to provide a pull tab for adjusting the band; and the dimensions of the band and the associated slits being such that the friction forces generated during tightening of the band will be held constant irrelevant of whether the device is in use or not.

* * * * *